United States Patent [19]

Taniguchi

[11] 4,288,018

[45] Sep. 8, 1981

[54] FASTENING DEVICE FOR PAPERS

[76] Inventor: Fumio Taniguchi, 5, Ueno-cho 5-chome, Tajimi-shi, Gifu-ken, Japan

[21] Appl. No.: 83,954

[22] Filed: Oct. 10, 1979

[30] Foreign Application Priority Data

Oct. 30, 1978 [JP] Japan ..... 53-133587

[51] Int. Cl.[3] ..... B25C 1/02

[52] U.S. Cl. ..... 227/76; 227/78; 83/618

[58] Field of Search ..... 83/618; 227/76, 78

[56] References Cited

U.S. PATENT DOCUMENTS

| | | | |
|---|---|---|---|
| 3,101,478 | 8/1963 | Oussani | 227/76 |
| 4,002,281 | 1/1977 | Hsu | 227/76 X |
| 4,114,793 | 9/1978 | Hsu | 227/76 X |

FOREIGN PATENT DOCUMENTS

| | | | |
|---|---|---|---|
| 687908 | 2/1940 | Fed. Rep. of Germany | 227/76 |
| 1461377 | 1/1969 | Fed. Rep. of Germany | 227/76 |
| 2619961 | 11/1977 | Fed. Rep. of Germany | 227/76 |

*Primary Examiner*—Paul A. Bell

*Attorney, Agent, or Firm*—Browdy & Neimark

[57] ABSTRACT

A paper fastening device comprises a punching mechanism with punching depression members in vertical motion, a stapling mechanism with depression members for pushing out the contained staples and fastening papers together, a depression mechanism with pressing parts for depressing the depression members in said punching and stapling mechanisms, a selecting mechanism for selecting the interlocking of the pressing parts with said depression members by sliding said pressing parts, and a selection indicator in association with said selecting mechanism. Selection of punching or stapling or both thereof is effected at the indicator, and then the depression mechanism is operated, thereby the selected punching and/or stapling are applied to papers.

5 Claims, 8 Drawing Figures

FASTENING DEVICE FOR PAPERS

BACKGROUND OF THE INVENTION

The present invention relates to devices for fastening papers together and, more particularly, to a fastening device which permits the free selection of either the simultaneous operation of punching and stapling or the single operation of any of these.

Staplers for fastening papers together and punching devices for filing have long been used. However, these devices in prior art have disadvantages as hereinafter described. In general, papers are fastened together by stapling operation with a stapler. If the stapling is effected at a plurality of portions, the interval between the stapling portions is determined by clinging to intuition. When papers are to be filed, holes are punched at a specified interval by a punching device therefore the punching operation may cut the staples at irregular fixing portions. Moreover the operation of stapling and punching in two steps is troublesome and less efficient. On the other hand, when the filing is effected by punched holes without the stapling operation, papers may be broken from the punched holes and they are liable to be lost. Also, when papers are not itemized by stapling, it is troublesome to pick up papers item by item from the file.

SUMMARY OF THE INVENTION

Accordingly, it is an object of the present invention to provide a fastening device which permits the simultaneous operation of punching and stapling, the rapid fastening work, and a definite interval between the punching and stapling positions.

It is another object of the present invention to provide a fastening device with a selecting mechanism to perform either punching or stapling if necessary.

Other objects of the present invention will become apparent from the following description of embodiments.

In order to accomplish the foregoing objects, the present invention is characterized in a fastening device which comprises a punching mechanism with punching depression members which move upwards and downwards, a stapling mechanism with depression members for pushing out the contained staples and fastening papers together, a depression mechanism with pressing parts for depressing the depression members in said punching and stapling mechanism, a selecting mechanism for selecting the interlocking of the pressing parts with said depression members by sliding said pressing parts, and a selection indicator in association with said selecting mechanism.

DESCRIPTION OF THE PREFERRED EMBODIMENTS

Figure 1:
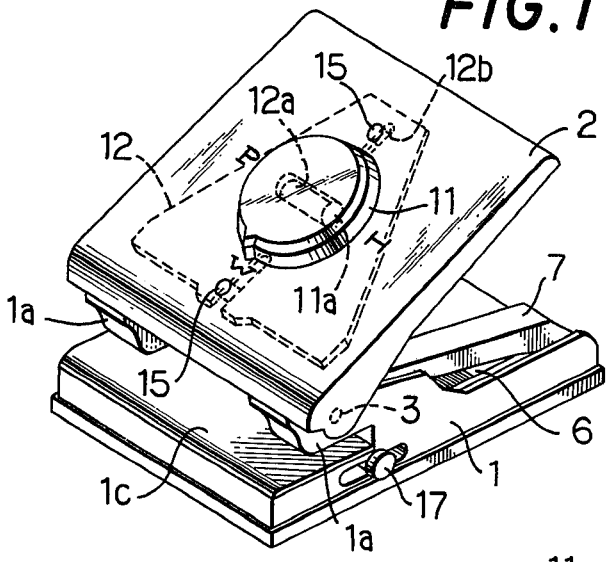
FIG. 1 is a perspective view illustrating an example of devices embodying the present invention.
Figure 2:
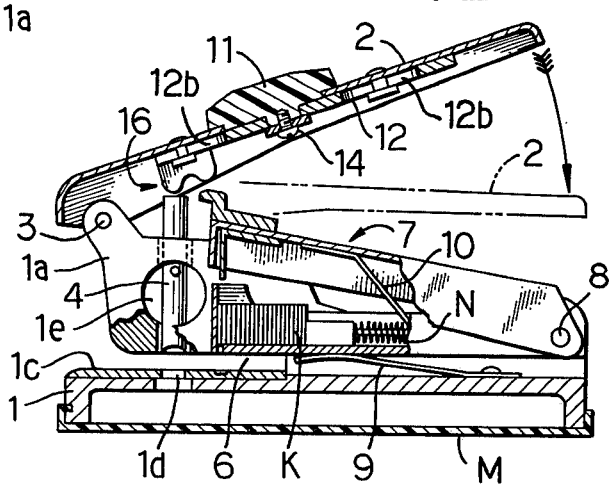
FIG. 2 is a side view of the device in FIG. 1, with a longitudinal section of a main portion.
Figure 3:
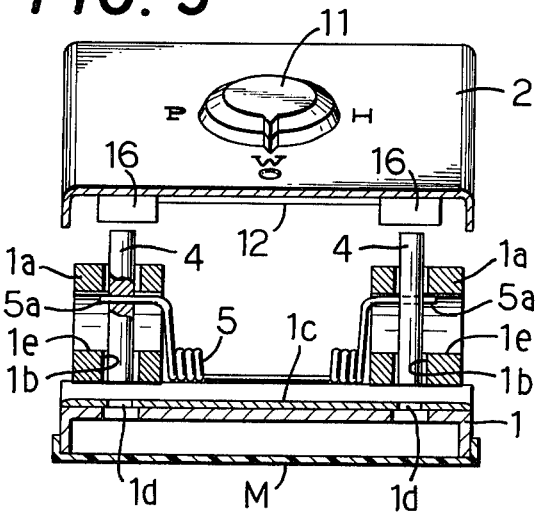
FIG. 3 is a front view in vertical section of the device in FIG. 1.

In order to explain the present invention in detail, embodiments thereof are illustrated in FIGS. 1 to 5. Referring to FIGS. 1 to 5, numeral 1 designates a bed plate made of metal or plastic, with poles 1*a*, 1*a* arranged at both sides. The bed plate 1 is connected to a pushing plate 2 by a pin 3 at the upper front of the poles 1*a*, 1*a*. In vertical guide holes 1*b*, 1*b* within the poles 1*a*, 1*a* are inserted respectively punching depression members 4, 4 which are made of metal and formed in cylinders with punching edge at the lower ends. The bed plate 1 constitutes a laying part 1*c* for papers below the depression members 4,4, and punching holes 1*d*, 1*d* penetrate the laying part 1*c*. Lateral holes 1*e*, 1*e* penetrate the poles 1*a*, 1*a* respectively, and a coil spring 5 arranged between the poles 1*a*, 1*a* is provided with both bent ends 5*a*, 5*a* connected respectively to holes of the depression members 4, 4 through the lateral holes 1*e*, 1*e* of the poles 1*a*, 1*a*. Thereby the depression members 4, 4 are normally forced upwards. At the rear of said depression members 4, 4 is installed a stapling mechanism, which comprises cases 6, 6 of metal or plastic arranged on the bed plate 1 for holding staples K, and depression members 7, 7 of U-shaped section with pressure receiving parts 7*a*, 7*a* of metal or plastic welded at the upper front thereof. Extrusion holes 6*a*, 6*a* through which the front staple K is pushed out are constituted respectively on the front end of the bottom of said cases 6, 6, and stapling anvil 1*n* is arranged on the laying part 1*c* below said extrusion holes 6*a*, 6*a*. Since the depression members 7, 7 are connected to the cases 6, 6 by a pin 8 at the rear, they can swing round said pin 8. Downward extrusion drivers 7*b*, 7*b* which push out the front staple K contained in the cases 6, 6 through the extrusion holes 6*a*, 6*a*, are welded respectively to the depression members 7, 7. The cases 6, 6 have the rear which is connected to the bed plate 1 and the front which is put onto plate springs 9, 9 fixed to the bed plate 1, while plate springs 10, 10 in contact with the cases 6, 6 are welded respectively to the depression members 7, 7, thereby the cases 6, 6 and the depression members 7, 7 are normally forced upwards. A compression spring N installed within the cases 6, 6 normally pushes the staples K forwards. Thus the punching and stpling functions are performed respectively at the punching anvil 1*d* and the stapling hole 1*n* by means of vertical motion of the punching depression members 4, 4 and the stapling depression members 7, 7. A knob 11 made of plastic or metal is fitted to the pushing plate 2, and an eccentric projection 11*a* protrudes from the bottom of the knob 11. A moving plate 12 made of metal or plastic is provided with a lateral slot 12*a* which penetrates its center and is fitted to the projection 11*a*. A screw 14 is fixed to the projection 11*a* through a washer 13 so that the moving plate 12 is slidably supported by the washer 13 and the pushing plate 2. Thus the knob 11 is turned and thereby the projection 11*a* is turned so as to slide the moving plate 12 forwards and backwards. In order to guide the sliding motion of the moving plate 12 in the forward and backward direction, longitudinal slots 12*b*, 12*b* are constituted at the front and the rear of the moving plate 12, and pins 15, 15 pass through attaching holes on the pushing plate 2 up to said slots 12*b*, 12*b*. The moving plate 12 is also provided with pressing members 16, 16 welded at the bottom of its both sides. The front and the rear of the bottom of each pressing member 16 protrude downwards and constitute pressing parts 16*a*, 16*b* arranged in line. When the pushing plate 2 is depressed, the pressing parts 16*a*, 16*b* are brought into contact respectively with the top of the punching depression members 4, 4 and the pressure receiving parts 7*a*, 7*a* of the stapling depression members 7, 7 and then depress these punching and stapling depression members. In addition, an indicating part with letters P, W, H is constituted on the pushing plate 2 to which the knob 11 is fitted. Thus a selecting mechanism is constituted by the knob 11 and the moving plate 12 which is slided by the projection 11*a* of the knob 11. A depression mechanism is constituted by the pressing parts 16*a*, 16*b* and the pushing plate 2 which swings round the pin 3. Numeral 17 designates a lever which adjusts the inserting depth of papers. Also M designates a bottom cover made of plastic, and punched scrap of papers stored at the bottom of the bed plate 1 is removed by opening the bottom cover M.

Figure 4:
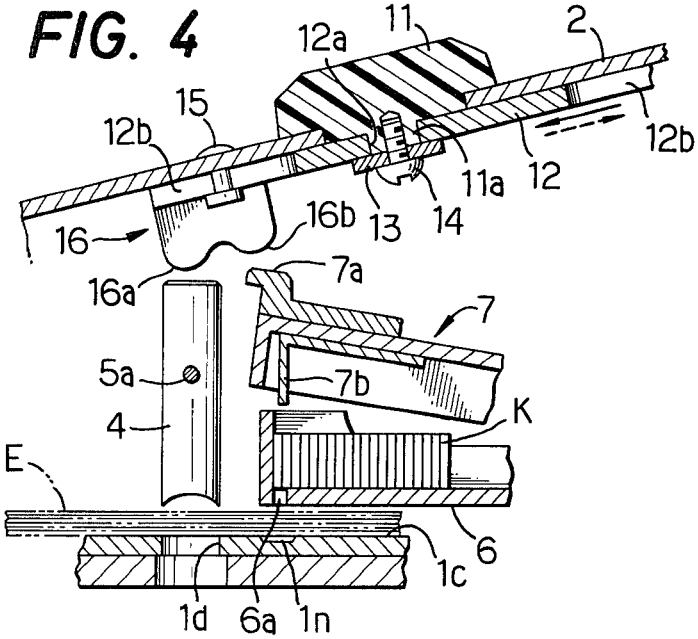
FIG. 4 is a side view in vertical section of a main portion of the device in FIG. 1.
Figure 6:
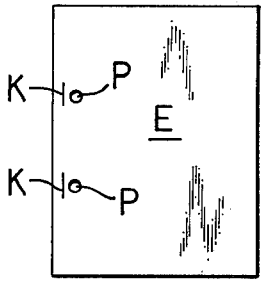
FIG. 6 illustrates a plan view of papers which are punched and stapled by means of the device in FIG. 1.

The operation of the above described mechanisms of the embodiment will now be explained. Papers E are inserted and held in the laying part 1*c*, and then the knob 11 is set to W-letter of the pushing plate 2. Thereby the front pressing parts 16*a*, 16*a* are located above the punching depression members 4, 4 and the rear pressing parts 16*b*, 16*b* are above the stapling depression members 7, 7 as shown in FIG. 4. Accordingly, if the pushing plate 2 is pushed down in this state, it swings downwards round the pin 3 thereby the pressing parts 16*a*, 16*b* respectively depresses the depression members 4, 7, so that punched holes P are applied to the papers E, and the staples K pushed out of the extrusion hole 6*a* by the downward motion of the extrusion piece 7*b* fasten the papers together as shown in FIG. 6. If the pressure of the pushing plate 2 is released, the restoring force of the spring 5 drives the depression members 4, 4 upwards into the original position, and also the restoring force of the plate springs 9, 10 drives the cases 6, 6 and the depression members 7, 7 upwards into the original position. Thus punching and stapling can be effected in one operation, and filing of the papers E with the punched holes P is facilitated.

Figure 5:
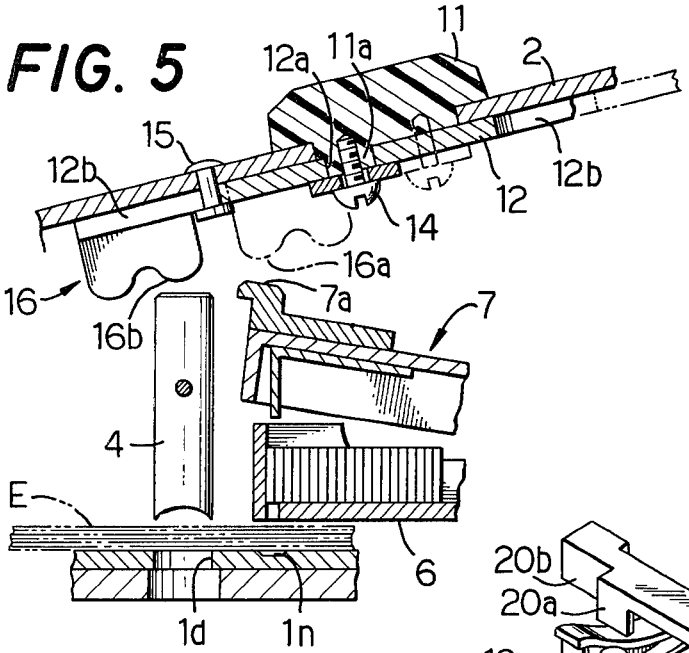
FIG. 5 is a side view in vertical section illustrating the state where the pressing parts 16*a*, 16*b* in FIG. 4 are moved by turning the knob.

When the knob 11 is turned to the position of P-letter of the pushing plate 2, the projection 11*a* moves along the slot 12*a* of the moving plate 12 thereby the moving plate 12 is slided forwards as shown in FIG. 5. Thus the rear pressing parts 16*b*, 16*b* are located above the punching depression members 4, 4, while any of the depression members 4, 7 is not located below the forward pressing parts 16*a*, 16*a*. Accordingly, if the pushing plate 2 is pushed down in this state, the rear pressing parts 16*b*, 16*b* depress the punching depression members 4, 4 thereby the punched holes P are applied to the papers E but stapling is not effected.

When the knob 11 is turned to the position of H-letter of the pushing plate 2, the projection 11*a* slides the moving plate 12 rearwards in similar manner to the foregoing. Thus the forward pressing parts 16*a*, 16*a* are located above the stapling depression members 7, 7. Accordingly, if the pushing plate 2 is pushed down in this state, only stapling is effected on the papers E. Thus in the selecting mechanism the moving plate 12 is slided by turning the knob 11, therefore the simultaneous operation of punching and stapling or the single operation of any of these may be selected only by setting the knob 11 to any prescribed indicating position. In addition, in order to set the moving plate 12 to any position stably, the pushing plate 2 and the knob 11 may be engaged through concave and convex portions respectively constituted on them, or a coil spring may be wound to the screw 14 so as to tighten the moving plate 12, or other suitable means may be adopted. Further the punching depression members 4, 4 and the stapling depression members 7, 7 may be depressed by an electric motor. In this case, it is preferable to install a switch for starting the motor operation by inserting papers.

In order to charge the staples K in the cases 6, 6, the pushing plate 2 is swung upwards round the pin 3 and opened, and the depression members 7, 7 are swung upwards round the pin 8 so that the cases 6, 6 are exposed and then the staples K are inserted in the cases 6, 6.

Figure 8:
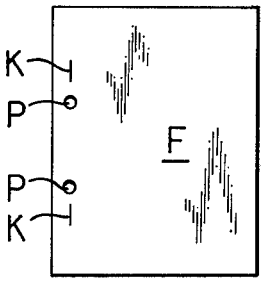
FIG. 8 is a plan view of papers which are punched and stapled by means of the device in FIG. 7.
Figure 7:
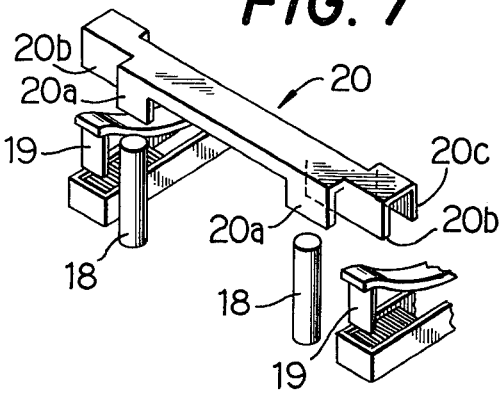
FIG. 7 is a perspective view illustrating a main portion of another embodiment.

Referring to FIG. 7, another embodiment will be explained. This device applies punched holes P and staples K aligned in the longitudinal direction. Stapling depression drivers 19, 19 are arranged outwards to punching depression members 18, 18, and a pressing member 20 depresses the punching and stapling depression drivers 18, 19. The bottom configuration at both sides of the pressing member 20 is constituted in three steps, that is, a pressing part 20*a* of the depression members 18, 18 at the front; a pressing part 20*b* at the center for depressing the depression drivers 18, 18, 19, 19 at one operation; and a pressing part 20*c* at the rear for depressing the stapling depression drivers 19, 19. Accordingly, when the pressing part 20 is moved by the knob and the pushing plate is pushed down, selection of the simultaneous operation of punching and stapling or the single operation of any of these may be effected as shown in FIG. 8.

Although the preferred embodiments are constituted as above described, it is understood that various changes and modifications may be made in the material, operation, shape, size and details of construction within the scope of the invention as hereinafter claimed and that the present invention is not limited to the specific embodiments thereof.

In the present invention as explained in detail, the punching mechanism and the stapling mechanism may be simultaneously operated so that punching and stapling can be rapidly effected in one operation. Moreover a definite interval between the punching and stapling positions permits the papers to be fastened correctly. This prevents the staples from being cut during the punching operation. Since the selecting mechanism and the indicating mechanism are provided, the single operation of punching or stapling is effected if necessary. The device which performs the simultaneous operation of punching at the inside and stapling at the outside in one line has advantage that the stapling portion prevents the breakage of papers from the punched holes towards the adjacent portions. Thus the present invention provides a fastenin device for papers with practical usefulness.

What is claimed is:

1. A fastening device for papers, comprising:

a punching mechanism with punching depression drivers which move upwards and downwards;

a stapling mechanism with depression drivers for pushing out contained staples and fastening papers together;

a depression mechanism with pressing parts for depressing the depression drivers in said punching and stapling mechanisms;

a selecting mechanism knob for selecting the interlocking of the pressing parts with said depression drivers by sliding a moving plate comprising said pressing parts; and a selection indicator in association with said selecting mechanism, wherein the selection indicator is installed around the knob of the selecting mechanism, and the indication is effected by rotation of the knob which slides the plate comprising said pressing parts in three steps corresponding to the selection of punching or stapling or both thereof.

2. A fastening device for papers according to claim 1 wherein said selecting mechanism comprises a moving plate slidable in forward and rearward direction by a projection which extrudes from a knob, and said moving plate is provided with pressing parts for depressing the depression drivers.

3. A fastening device for papers according to claim 1, wherein said depression mechanism comprises a pushing plate connected to a bed plate by a pin at the front of the bed plate, and the pushing plate swings downwards round the pin, there by said pressing parts are depressed.

4. A fastening device for papers according to claim 1, wherein the punching depression drivers in the punching mechanism are arranged behind the depression drivers in the stapling mechanism.

5. A fastening device for papers according to claim 1, wherein the punching depression drivers in the punching mechanism are arranged outside the depression drivers in the stapling mechanism, and the depression drivers in both punching and stapling mechanisms are aligned.

* * * * *